US005915604A

United States Patent [19]

Farrar et al.

[11] Patent Number: 5,915,604

[45] Date of Patent: Jun. 29, 1999

[54] TIE HANGING DEVICE

[76] Inventors: James S. Farrar; Estella Sifuentes Farrar, both of 3838 Running Springs, San Antonio, Tex. 78261

[21] Appl. No.: 09/018,903

[22] Filed: Feb. 5, 1998

[51] Int. Cl.[6] ..... A47G 25/74

[52] U.S. Cl. ..... 223/85; 223/DIG. 1

[58] Field of Search ..... 223/DIG. 1, 85, 223/DIG. 4, 92

[56] References Cited

U.S. PATENT DOCUMENTS

| | | | |
|---|---|---|---|
| D. 201,112 | 5/1965 | Stein . | |
| D. 209,434 | 11/1967 | Jamison | 223/DIG. 1 |
| D. 297,484 | 9/1988 | Fan . | |
| 3,370,715 | 2/1968 | Kolozsvari | 223/DIG. 1 |
| 3,993,205 | 11/1976 | Pilchard | 223/DIG. 1 |
| 4,346,825 | 8/1982 | Leger . | |
| 4,593,812 | 6/1986 | Dillingham | 223/DIG. 1 |
| 4,632,285 | 12/1986 | Dillingham | 223/DIG. 1 |
| 4,811,852 | 3/1989 | Kelly | 223/DIG. 1 |
| 4,978,043 | 12/1990 | Uke . | |
| 5,110,019 | 5/1992 | Kolton et al. . | |
| 5,123,577 | 6/1992 | Kolton et al. . | |
| 5,526,968 | 6/1996 | Larson | 223/DIG. 1 |
| 5,620,118 | 4/1997 | Kolton et al. . | |

FOREIGN PATENT DOCUMENTS

| | | |
|---|---|---|
| 2043440 | 2/1979 | United Kingdom . |

*Primary Examiner*—Bibhu Mohanty
*Attorney, Agent, or Firm*—Miller Sisson Chapman &Nash P.C.

[57] ABSTRACT

These and other objects are provided for in a tie hanging device which includes a frame having a pair of side walls, a top wall, and a bottom wall, the walls defining an inner central opening into which a tongue projects vertically upward from the bottom wall partially into the central opening, the tongue for engaging a multiplicity of neckties or scarves at about the center of the neckties or scarves with the remainder of the neckties or scarves encircling the tongue and hanging down over the bottom wall.

5 Claims, 5 Drawing Sheets

TIE HANGING DEVICE

FIELD OF THE INVENTION

A tie hanging device, more specifically, a tie hanging device comprising a frame defining an inner central opening with a closed tongue protruding vertically upward into the opening, the frame mounted on a mounting means to a support surface.

BACKGROUND OF THE INVENTION

Clothing is typically hung vertically to maintain it wrinkle-free and clean. While jackets and pants are typically hung on clothing hangers, ties (such as neckties or scarves) also need to be maintained in a hanging or vertical position.

Applicant provides a novel device for maintaining neckties, scarves, or the like in a vertical position, the device capable of locating and maintaining a number of neckties or scarves either on a rod hanger or from a wall or other vertical support surface.

OBJECTS OF THE INVENTION

It is an object of Applicant's invention to provide a device for maintaining a number of neckties or scarves in a vertical position.

It is a further object of the present invention to provide a device for maintaining a number of neckties or scarves in a vertical position, securely, but which device may be easily mounted to a rod or a vertical support surface.

SUMMARY OF THE INVENTION

These and other objects are provided for in a tie hanging device which includes a frame having a pair of side walls, a top wall, and a bottom wall, the walls defining an inner central opening into which a tongue projects vertically upward from the bottom wall partially into the central opening, the tongue for engaging a multiplicity of neckties or scarves at about the center of the neckties or scarves with the remainder of the neckties or scarves encircling the tongue and hanging down over the bottom wall.

DETAILED DESCRIPTION OF THE PREFERRED EMBODIMENT

Figure 1A:
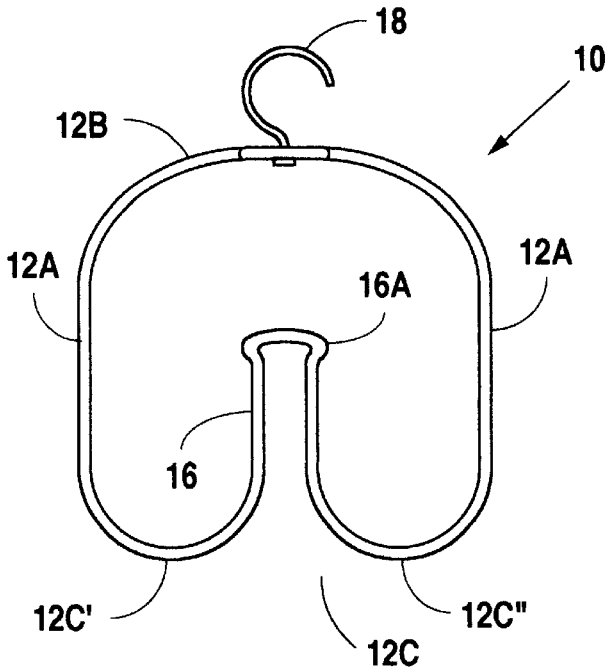
FIGS. 1A and 1B are embodiments of Applicant's invention in front elevation and top elevation views, respectively.

FIG. 1A illustrates Applicant's tie hanging device (10) as comprised of a frame (12), the frame having a pair of downwardly depending side walls (12A) connected to a top wall (12B) and a bottom wall (12C), the bottom wall (12C) may have two sections (12C') and (12C"). The side walls, top wall, and bottom wall(s) define a inner central opening (14) into which protrudes, upward from bottom walls (12C), a clothes tongue (16) sometimes having a knob (16A) thereon. The tongue is seen to project vertically and define the bottom wall at the bottom wall into sections (12C') and (12C"). Support means (18), here a hook, engages top wall (12B) centrally thereon to hang the tie hanging device (10) from a bar or coat hanging rod.

Figure 1B:
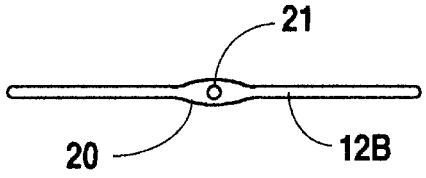

FIG. 1B illustrates that a portion (20) of top wall (12B) may be flattened to provide for support means retainer means (21), here a hole, in top wall (12B) which will engage support means (18), here a swivel hook, to allow the frame to pivot on support means (18) as the support means engages a support bar or rod. Ties, scarves, or other long clothing items are suspended around tongue (16) and left to hang, a portion over bottom wall (12C') and another portion over bottom wall (12C").

Figure 2A:
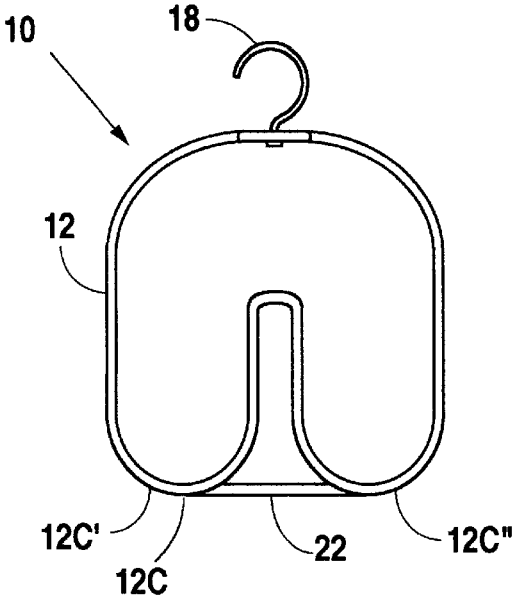
FIGS. 2A and 2B is an additional embodiment of Applicant's invention in front elevation and side elevation views, respectively.
Figure 2B:
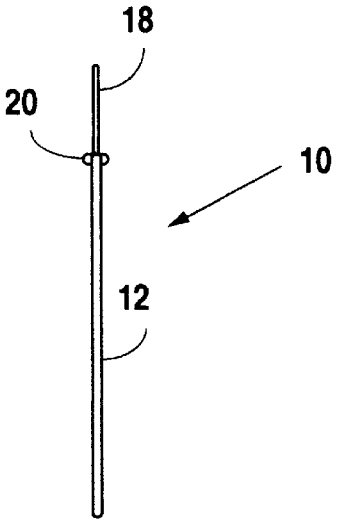

FIGS. 2A and 2B illustrate another preferred embodiment of Applicant's present invention. Here the embodiment illustrated in FIGS. 1A and 1B having frame (12) engaging support means (18) but, in this preferred embodiment illustrated, there is no knob (16A) at the upper end of clothes tongue (16); the knob in FIGS. 1A and 1B embodiment is helpful in preventing the neckties, scarves, or other clothing device from sliding off the top of the tongue when one is being removed and there are several others on the tie hanging device. Further, it is noted with reference to FIGS. 2A and 2B that a tongue brace support (22) crosses over between the two sections of the bottom wall. This provides additional bracing for the tongue.

The frames for the embodiments discussed above may be made of ¼ or ⅜ steel or brass and the swiveling hanger or the support means (18) made of a similar material.

Figure 3A:
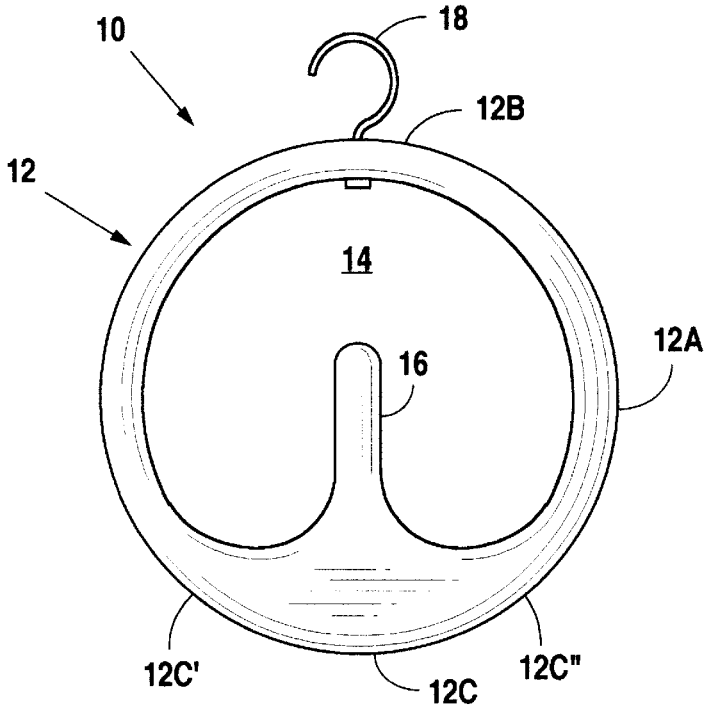
FIGS. 3A and 3B are front elevation and side elevation views, respectively, of another preferred embodiment of Applicant's invention.
Figure 3B:
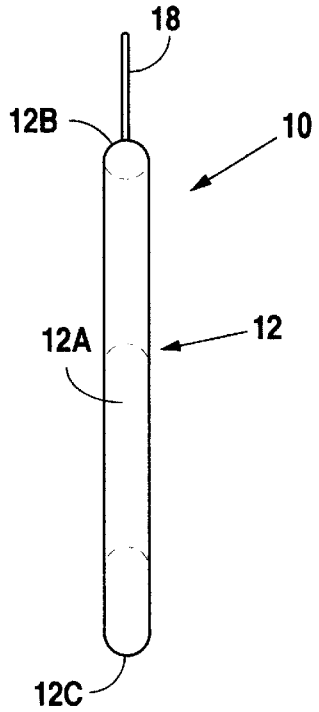

FIGS. 3A and 3B illustrate another preferred embodiment of Applicant's present invention, here made of solid plastic, solid wood, or hollow brass. Again, the main elements of Applicant's tie hanging device (10) are present here, namely, frame (12) having side walls (12A) and (12B), bottom wall (12C), and top wall (12D) in two sections separated by vertically depending tongue (16). However, unlike the earlier embodiments, the frame of the embodiment illustrated in these figures is circular. Ties are hung in the same fashion as they are in the earlier embodiments, that is, around clothes tongue (16) and hanging over sections of the bottom wall. The frame is hung from hook swivels or other support means (18) on a support rod or bar.

Figure 4A:
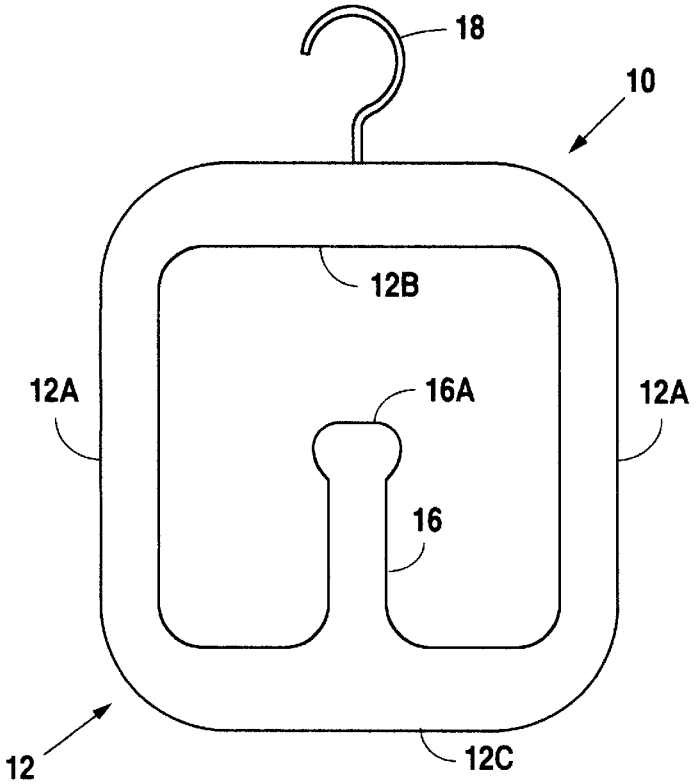
FIGS. 4A and 4B are front elevation and side elevation views, respectively, of another preferred embodiment of Applicant's present invention.
Figure 4B:
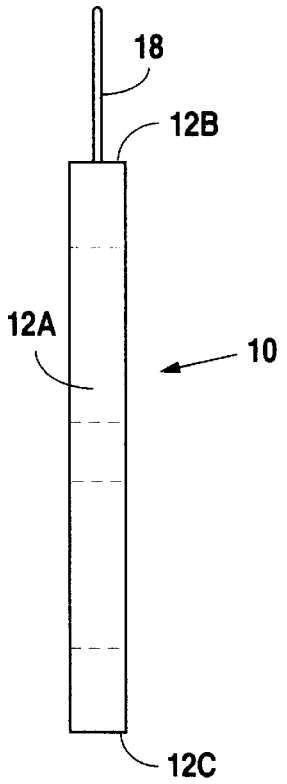

FIGS. 4A and 4B illustrate another alternate preferred embodiment of Applicant's present invention, having a solid plastic, solid wood, or hollow brass frame in a rectangular shape for suspension from a clothing bar or rod by means of support means (18).

Figure 5A:
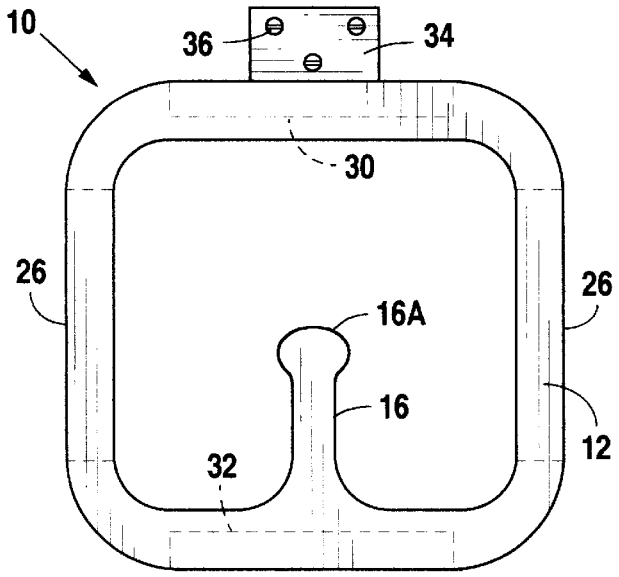
FIGS. 5A and 5B are front and side elevation views, respectively, of another preferred embodiment of Applicant's present invention.
Figure 5B:
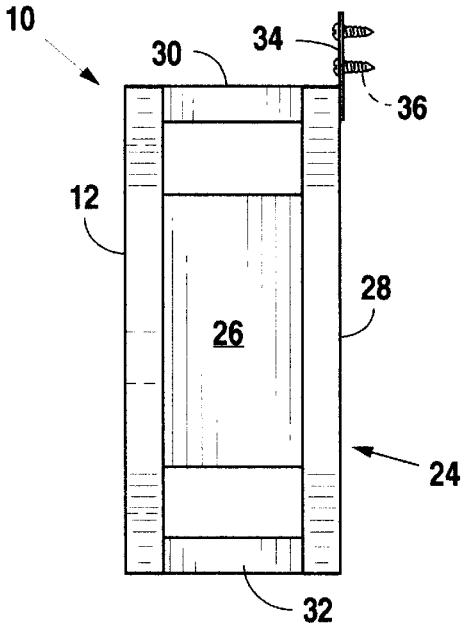

FIGS. 5A and 5B illustrate another alternate preferred embodiment of Applicant's present invention, comprising a frame similar to those set forth above but made of wood, with the frame attached to a housing (24), the housing having side walls (26), back wall (28), top wall (30), and, optionally, a housing bottom wall (32). The use of the housing behind the frame in conjunction with the use of a wall hanger, such as brass plate (34) combined with fasteners (36), allows tie hanging device (10) to be mounted to a vertical support surface, such as the wall of a closet, allowing the ties, when hanging on tongue (16) to be protected from surrounding elements in the closet. Also, the housing could be faced on both front and back with the frame seen in FIG. 5A (so a back view of this embodiment would look like FIG. 5A). In such an embodiment, ties could hang from both sides with the device being hung on a hook centrally mounted on the housing between the two frames. The housing allows the clothing accessories to be hung around the tongue and at lease partly within the housing when the housing is without the housing bottom wall (32). The accessories could hang down partly within the housing.

Figure 6A:
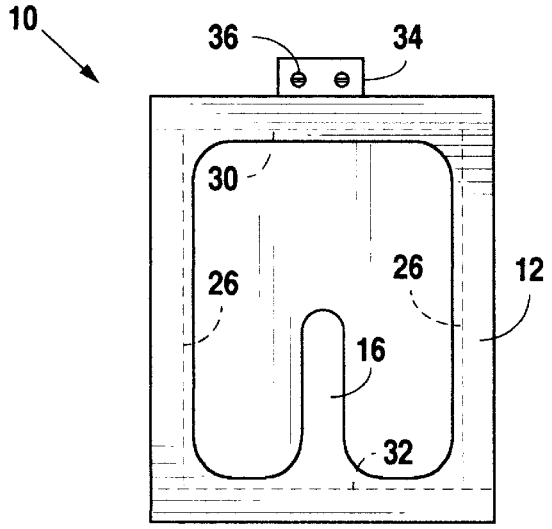
FIGS. 6A, 6B, and 6C are front, side, and top elevation views, respectively, of another preferred embodiment of Applicant's present invention.
Figure 6B:
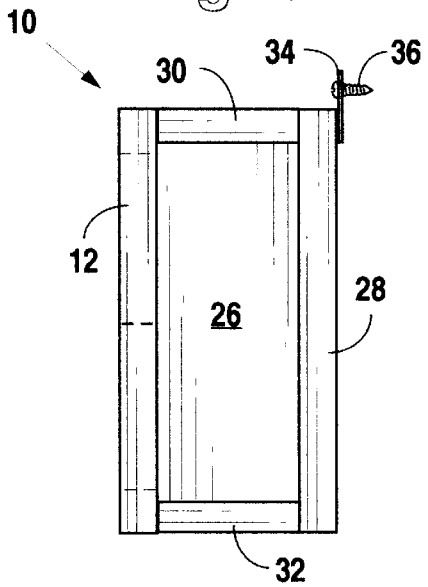
Figure 6C:
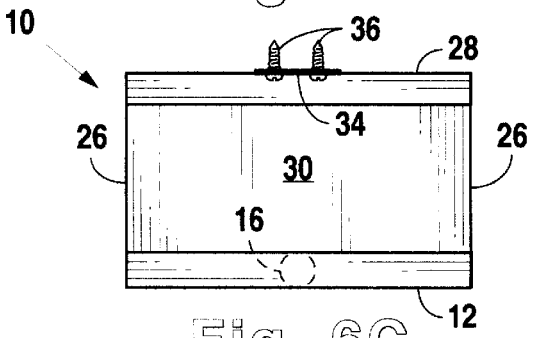

It is seen that brass plate (34) may be fastened to the back of the housing and then screwed to a wall or other vertical support surface. FIGS. 6A, 6B, and 6C illustrate the use of frame (12) having housing (24) differing from that illustrated in FIGS. 5A and 5B in that the housing includes side walls, back wall, and top wall (26), (28), and (30) and bottom wall (32) together which completely enclose the housing. That is, the bottom, side wall, and top walls adjoin along with the back wall to define a housing having a solid wood walls all connected and having a front defined by frame (12), again providing some protection for neckties, scarves, or other clothing hanging from tongue (16).

Other alternate preferred embodiments to that illustrated in FIG. 6A may have a swivel mounted hanger centrally located on the top wall to suspend the tie hanging device (10) from a clothing rod or a bar in a closet and may, optionally, replace back wall (28) with a second frame (12) in place of back wall (28) so on one tie hanging device (10) there are two frames (12) with two tongues (16), and the unit is capable of being suspended on a swivel hanger from a rod or bar in a closet.

Figure 7B:
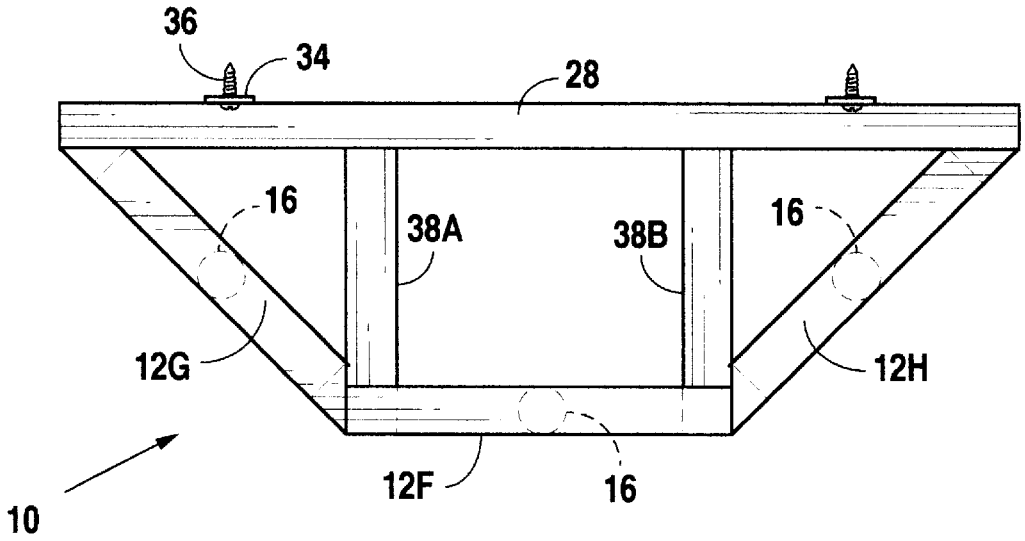
FIGS. 7A and 7B are front and top elevation views, respectively, of another preferred embodiment of Applicant's present invention.
Figure 7A:
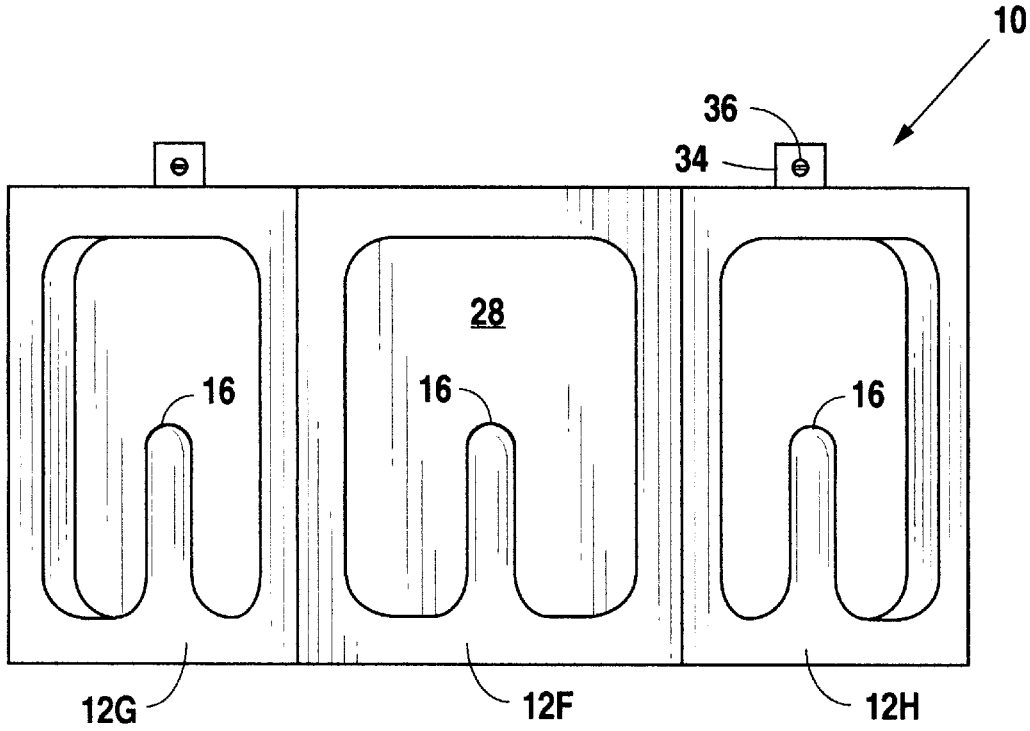
Figure 8B:
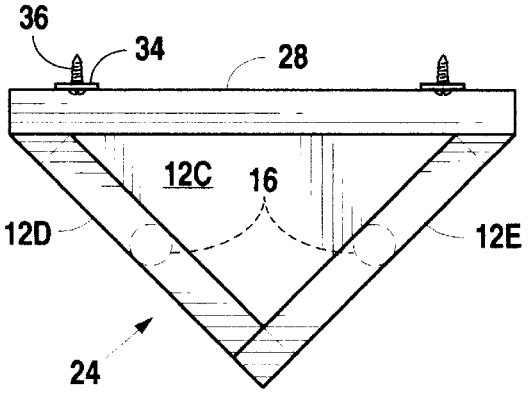
FIGS. 8A, 8B, 8C, and 8D are a front, two top elevation views, and a right side elevational view, respectively, of Applicant's present invention.
Figure 8C:
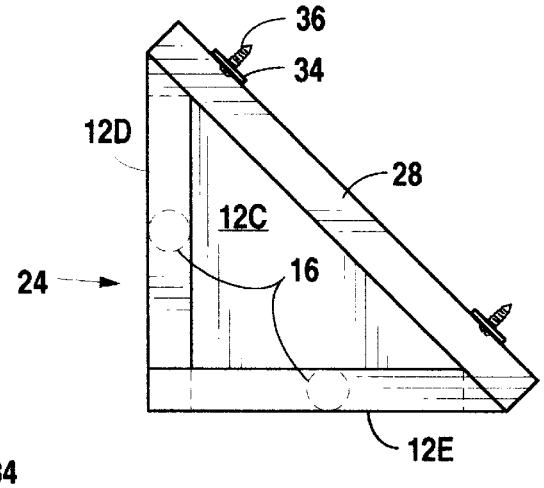
Figure 8A:
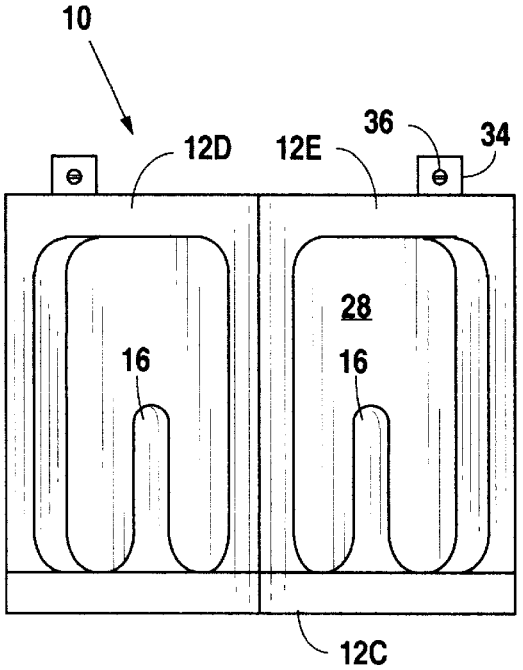
Figure 8D:
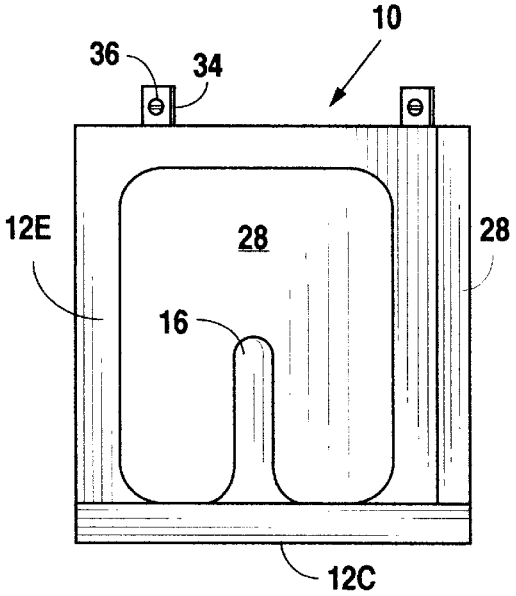

FIGS. 7A and 7B illustrate yet another alternate preferred embodiment of Applicant's present invention, this one having a trapezoidal shape when viewed from above with the front defined by a multiplicity of frames, here designated (12F), (12G), and (12H), each frame having its own tongue, the three frames joining back wall (28) through the use of bracing walls (38A) and (38B). The frame bracing walls and backing wall are typically made of wood, and the use of hangers such as brass plates (34) and fasteners (36) allow the unit to be attached to a vertical support surface, such as a wall. It is seen that use of this alternate preferred embodiment allows additional hanging space for the neckties, scarves, or other clothing items.

FIGS. 8A, 8B, 8C, and 8D illustrate yet another alternate preferred embodiment of Applicant's invention when viewed from above, having a triangular shape defined by a pair of frames (12D) and (12E) joined along one side at a 90° angle, each frame having a generally rectangular shape including side walls (12A), top wall (12B), bottom walls (12C), the walls defining an inner central opening into which projects vertically a tongue (16) from the bottom walls. Walls, plates, and fasteners may be used to attach the unit to a vertical support surface, such as the wall of a closet. It is seen that this alternate preferred embodiment provides more space for hanging the articles than a single frame, but not as much space as the triple frame device set forth with reference to FIGS. 7A and 7B above.

Thus, it is seen that Applicant provides a number of unique tie hanging devices all having one or more frames, the frames defining a closed inner space having a tongue vertically projecting upward therein, the tongue for suspending neckties, scarves, or the like to store the implements, such as from a vertical support wall or a clothing rod or bar.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A device for engaging a support surface for hanging neckties or other clothing accessories in a vertical position, the device comprising:

a first flat frame, said first flat frame defining a closed outer perimeter having an upper wall and side walls, and a central, open, interior space, said frame including a longitudinal tongue member extending vertically partially into the central, open, interior space between the side walls;

a second flat frame connected to the first frame, said second flat frame having an upper wall and side walls, and a central, open, interior space, said frame including a longitudinal tongue member extending vertically partially into the central, open, interior space between the side walls and attached to the first flat frame at an oblique angle; and support means, said support means for supporting the frames from the support surface.

2. The device of claim 1 further including a third flat frame, the third flat frame having an upper wall and side walls, and a central, open, interior space, said frame including a longitudinal tongue member extending vertically partially into the central, open, interior space between the side walls; and support means, said support means for supporting the third flat frame from the support surface.

3. A device for engaging a support surface for hanging neckties or other clothing accessories in a vertical position, the device comprising:

a multiplicity of flat frames connected to each other, each flat frame defining a closed outer perimeter having an upper wall and side walls in and a central, open interior space, each said frame including a longitudinal tongue member extending vertically partially into the central open interior space between the side walls the frames attached in non-parallel relation; and means to support said multiplicity of flat frames to a vertical surface.

4. The device of claim 3 further including three flat frames attached to one another at oblique angles and wherein the support means includes a tabular member engaging the frames, the tabular member for flush mounting to a vertical surface.

5. The device of claim 3 wherein said multiplicity of flat frames are made of wood and wherein the support means includes a tabular member engaging the flat frames to create an interior space within the device.

* * * * *